US011509093B2

(12) United States Patent
Yuk et al.

(10) Patent No.: US 11,509,093 B2
(45) Date of Patent: Nov. 22, 2022

(54) CONNECTOR ASSEMBLY DEVICE HAVING A CONNECTOR POSITION ASSURANCE DEVICE

(71) Applicant: Tyco Electronics France SAS, Pontoise (FR)

(72) Inventors: Hyunji Yuk, Pontoise (FR); Xavier Rouillard, Pontoise (FR); Carlos Salgado, Pontoise (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 17/154,221

(22) Filed: Jan. 21, 2021

(65) Prior Publication Data

US 2021/0226382 A1 Jul. 22, 2021

(30) Foreign Application Priority Data

Jan. 21, 2020 (FR) ..... 2000553

(51) Int. Cl.
*H01R 13/627* (2006.01)
*H01R 13/533* (2006.01)
*H01R 13/631* (2006.01)

(52) U.S. Cl.
CPC ..... *H01R 13/6273* (2013.01); *H01R 13/533* (2013.01); *H01R 13/631* (2013.01); *H01R 2201/26* (2013.01)

(58) Field of Classification Search
CPC ..... H01R 13/6273; H01R 13/533; H01R 13/631; H01R 2201/26
See application file for complete search history.

(56) References Cited

U.S. PATENT DOCUMENTS 8,016,606 B1 * 9/2011 Kwan ..... H01R 13/641 439/352
9,742,116 B1 * 8/2017 Nishiyama ..... H01R 13/6272
(Continued)

FOREIGN PATENT DOCUMENTS

DE 202017105774 U1 2/2019
EP 3211730 A1 8/2017
EP 3211730 A1 * 8/2017 ..... H01R 13/641

OTHER PUBLICATIONS

Search Report and Written Opinion, dated Sep. 9, 2020, 7 pages.
Intellectual Property Office combined Search and Examination Report, App. No. GB2100599.6, dated Sep. 29, 2021, 8 pages.

*Primary Examiner* — Abdullah A Riyami
*Assistant Examiner* — Nader J Alhawamdeh
(74) *Attorney, Agent, or Firm* — Barley Snyder

(57) ABSTRACT

A connector assembly device includes a connector element and a connector position assurance (CPA) device mounted to move relative to the connector element between a delivery position and a locking position. The connector element includes a first locking device and a second locking device. The CPA device includes a locking lance that has an associated first locking device configured to implement a first form-fitting connection with the first locking device of the connector element and an associated second locking device configured to implement a second form-fitting connection with the second locking device of the connector element in the locking position. The form-fitting connections prevent any movement of the CPA device in a direction from the locking position towards the delivery position and take place in different planes.

15 Claims, 8 Drawing Sheets

(56) References Cited

U.S. PATENT DOCUMENTS

| | | | | |
|---|---|---|---|---|
| 10,135,172 | B1 | 11/2018 | Foltz | |
| 2020/0321731 | A1* | 10/2020 | Misu | H01R 13/6272 |

* cited by examiner

CONNECTOR ASSEMBLY DEVICE HAVING A CONNECTOR POSITION ASSURANCE DEVICE

CROSS-REFERENCE TO RELATED APPLICATION

This application claims the benefit of the filing date under 35 U.S.C. § 119(a)-(d) of French Patent Application No. 2000553, filed on Jan. 21, 2020.

FIELD OF THE INVENTION

The present invention relates to a connector assembly device and, more particularly, to a connector assembly device having a connector position assurance (CPA) device.

BACKGROUND

A connector assembly having a connector position assurance (CPA) device that can be used in motor vehicles is disclosed in German Patent Application No. 20 2017 10 774 U1. The device of DE 20 2017 105 774 U1 includes a connector element configured to be plugged into and locked with a complementary connector. Furthermore, that connector includes a CPA device that makes it possible to check and to be assured that proper mating is maintained with the complementary connector, and in particular while the connector is being used in an environment that may be regularly subjected to shocks or vibration, as applies typically to the situation in which it is used in a motor vehicle. Maintaining proper mating is achieved by a central lance provided with a latch implementing a form-fitting connection with a retaining element of the connector element when the connector element is mated with the complementary connector and when the CPA device is in an assembly position relative to the connector element.

The CPA device further comprises secondary elements that are distinct from the lance and that are arranged on the lateral sides of the CPA device so as to maintain the CPA device in a position called a pre-assembly position relative to the connector element before insertion into the complementary connector. Maintaining the CPA device in the pre-assembly position is achieved by a cooperation between the secondary elements and cross-pieces present in the connector element.

SUMMARY

A connector assembly device includes a connector element and a connector position assurance (CPA) device mounted to move relative to the connector element between a delivery position and a locking position. The connector element includes a first locking device and a second locking device. The CPA device includes a locking lance that has an associated first locking device configured to implement a first form-fitting connection with the first locking device of the connector element and an associated second locking device configured to implement a second form-fitting connection with the second locking device of the connector element in the locking position. The form-fitting connections prevent any movement of the CPA device in a direction from the locking position towards the delivery position and take place in different planes.

BRIEF DESCRIPTION OF THE DRAWINGS

The invention will now be described by way of example with reference to the accompanying Figures, of which.

DETAILED DESCRIPTION OF THE EMBODIMENT(S)

The invention is described in more detail below by using advantageous embodiments by way of example and with reference to the drawings. The embodiments described are possible configurations, and it should be borne in mind that the individual characteristics as described herein may be provided independently from one another or be omitted entirely when implementing the present invention.

Figure 1B:
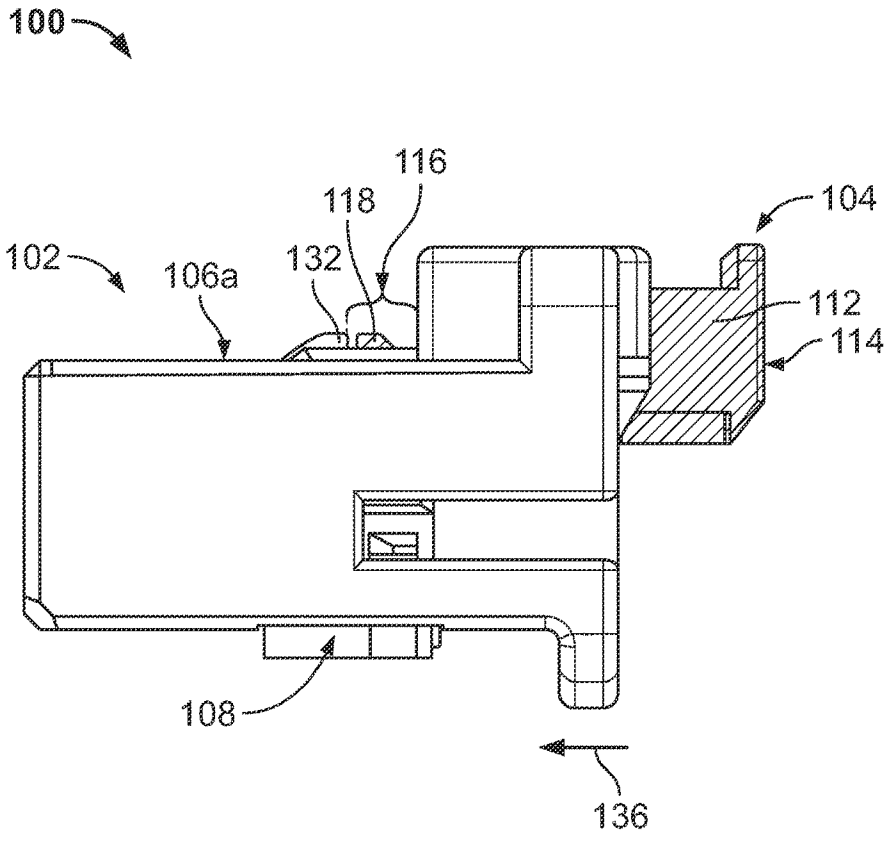
FIG. 1B is a sectional side view of the connector assembly device of FIG. 1A.
Figure 1A:
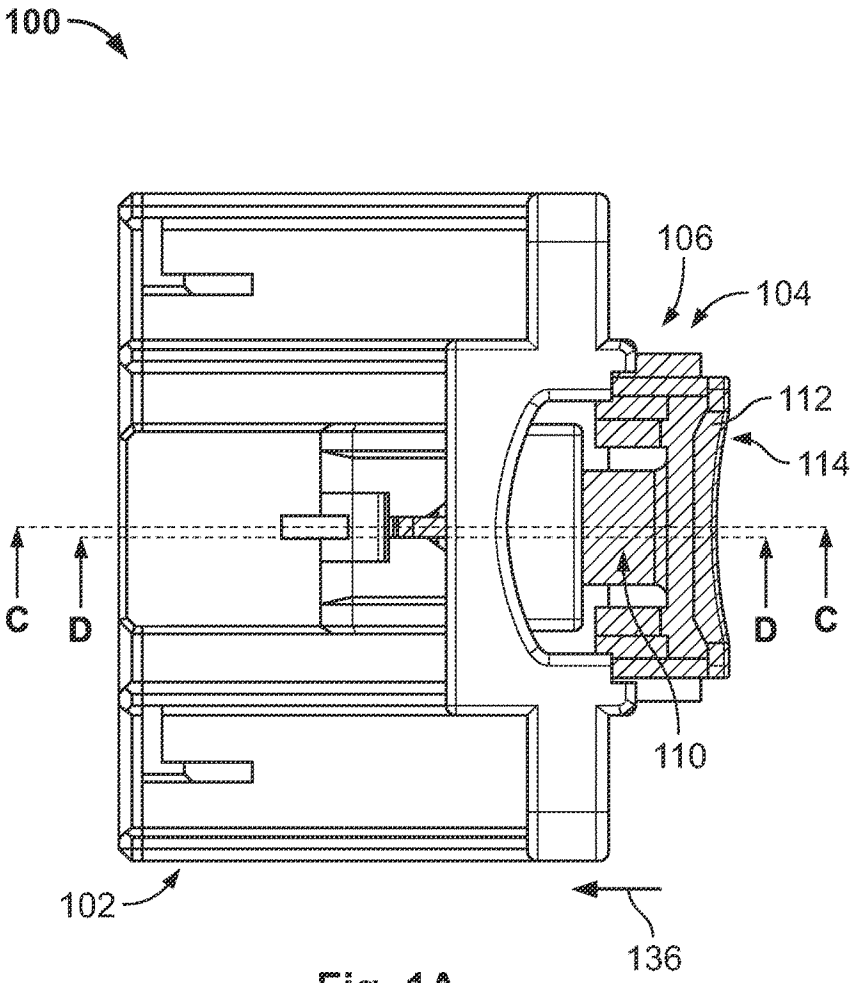
FIG. 1A is a sectional top view of a connector assembly device according to an embodiment with a CPA device in a delivery position.
Figures 1C, 1D:
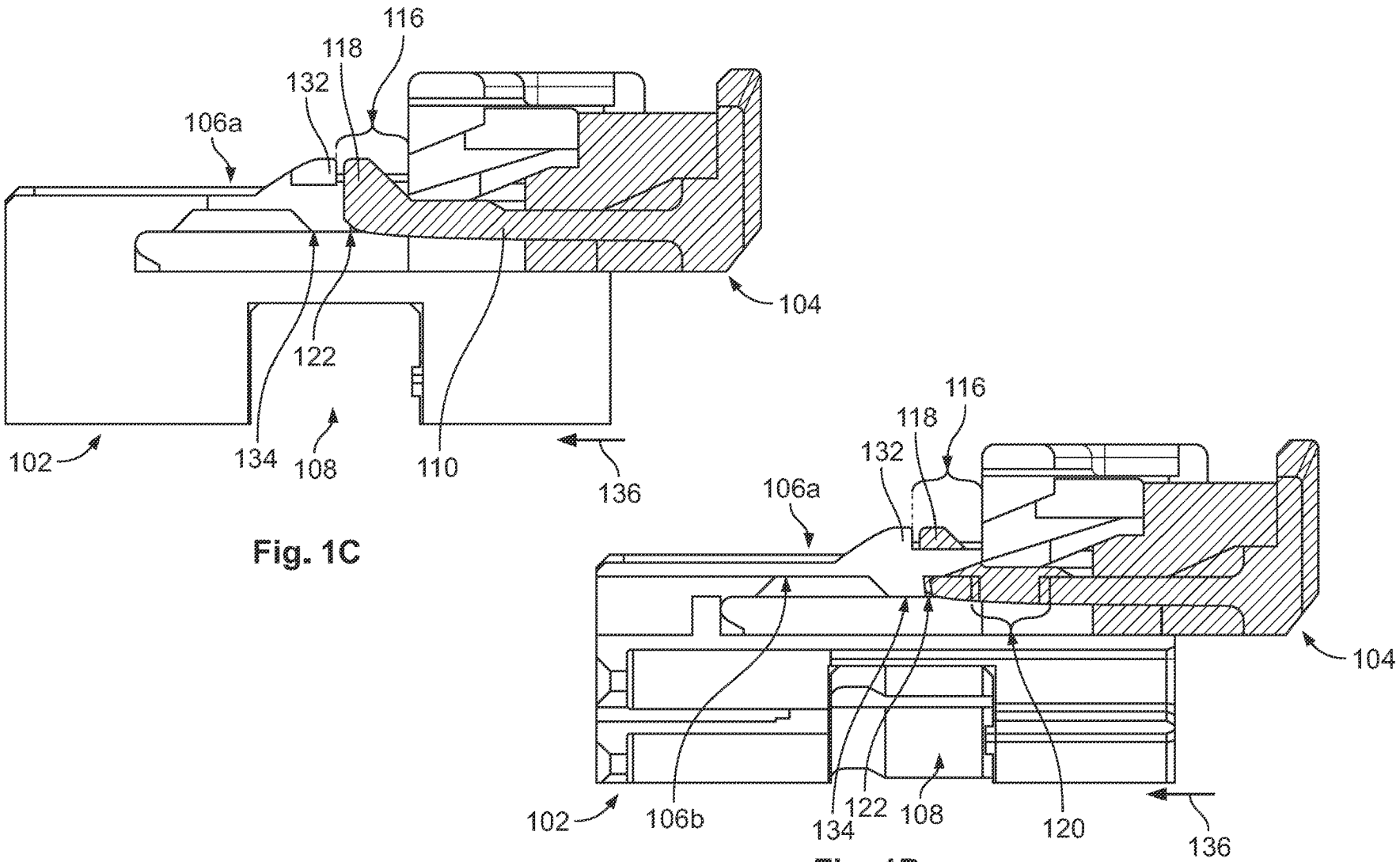
FIG. 1C is a sectional side view of the connector assembly device, taken along section C-C of FIG. 1A.
FIG. 1D is a sectional side view of the connector assembly device, taken along section D-D of FIG. 1A.
Figure 1E:
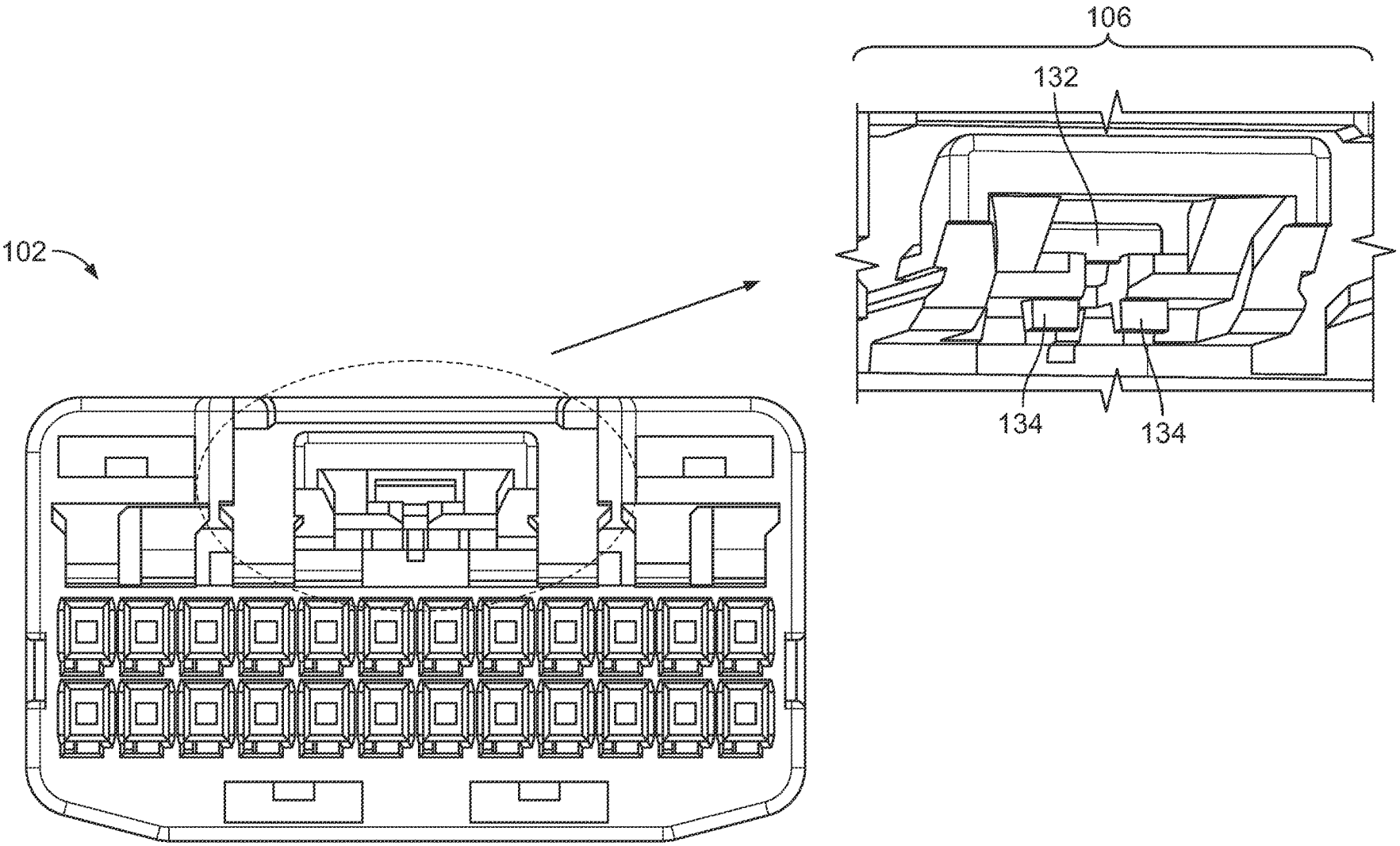
FIG. 1E is a front view of a connector element of the connector assembly device of FIG. 1A.
Figure 1G:
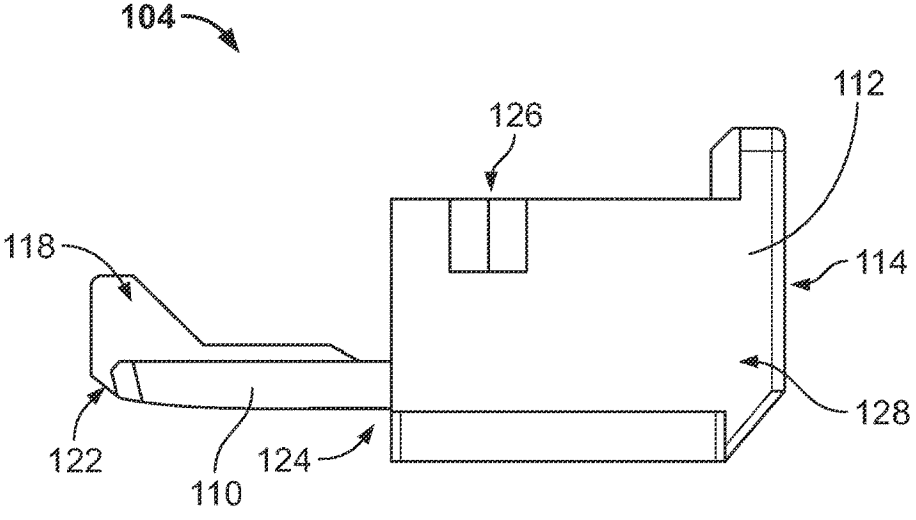
FIG. 1G is a side view of the CPA device of FIG. 1F.
Figure 1F:
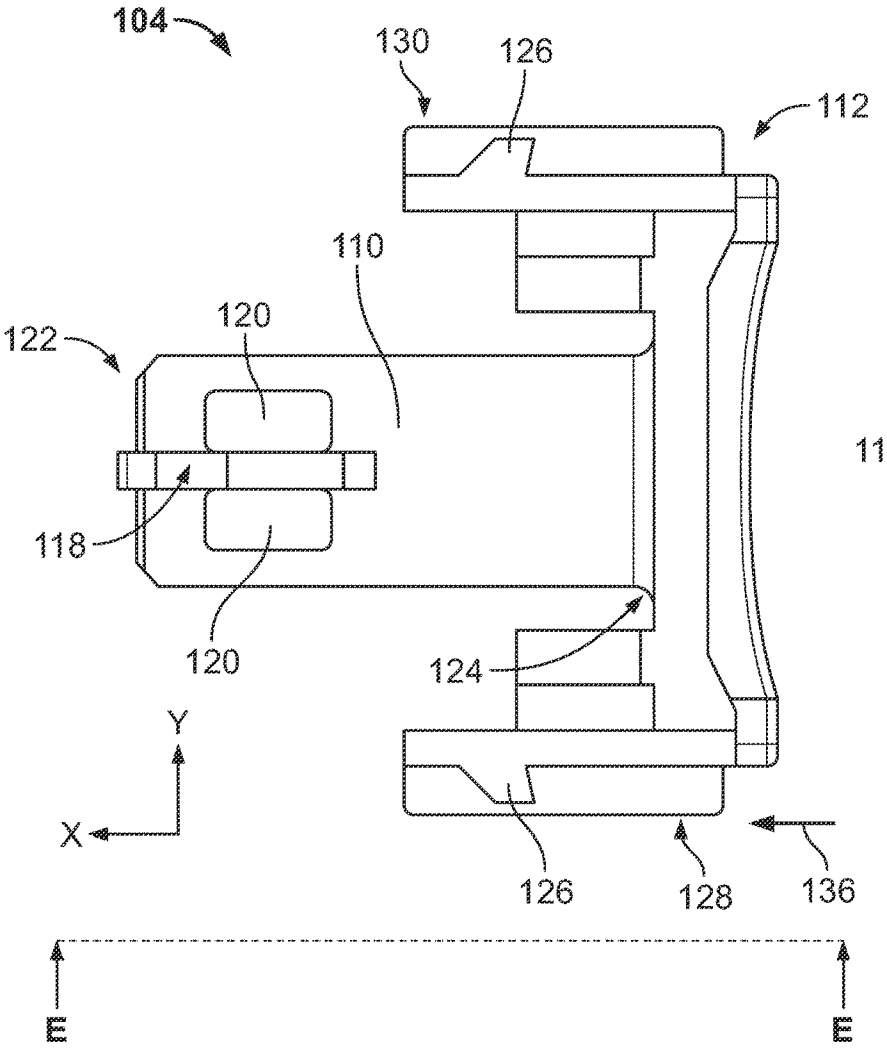
FIG. 1F is a top view of the CPA device of the connector assembly device of FIG. 1A.
Figure 2A:
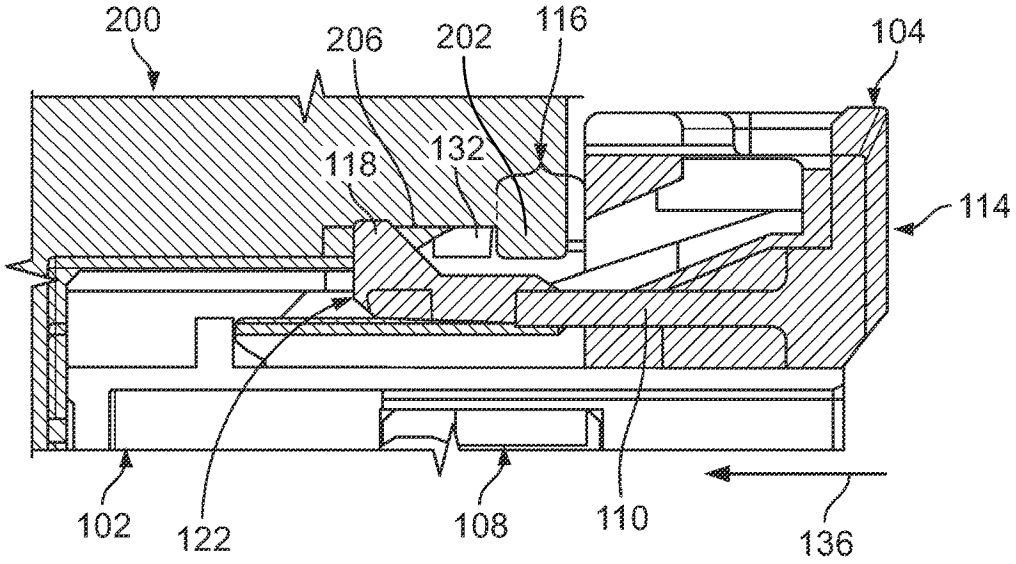
FIG. 2A is a sectional side view of the connector assembly device, taken along section C-C of FIG. 1A, in the presence of a complementary connector and with the CPA device in a locking position.
Figure 2B:
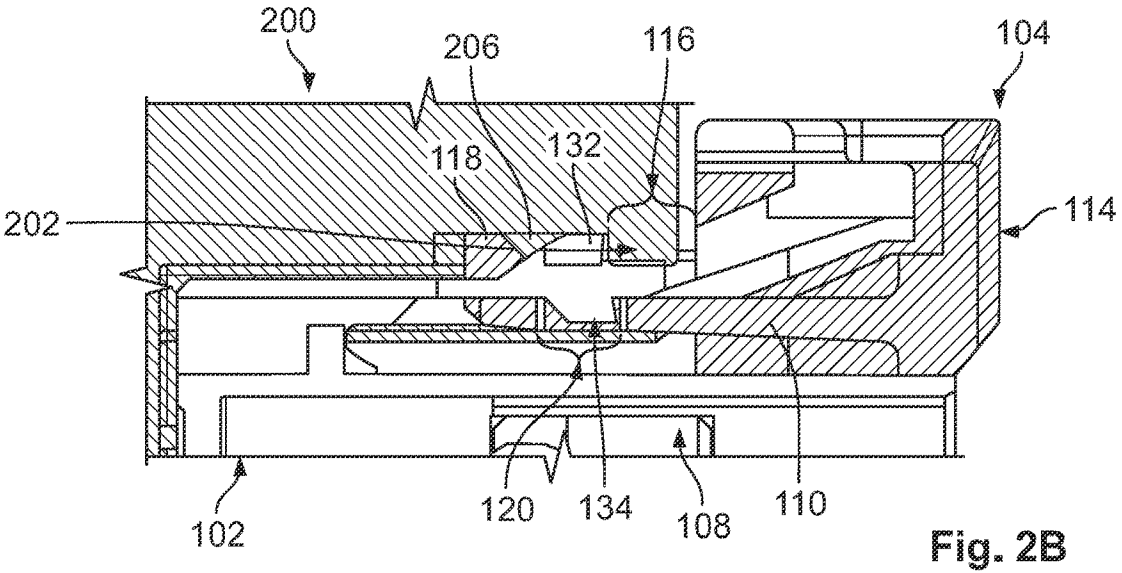
FIG. 2B is a sectional side view of the connector assembly device, taken along section D-D of FIG. 1A, in the presence of the complementary connector and with the CPA device in the locking position.

FIGS. 1A to 1G, 2A, 2B, 4, and 5 show the same first embodiment of an assembly device 100 of the invention in two different states. FIGS. 1A to 1G show the assembly device 100 in a state without a mating connector 200, and FIGS. 2A to 2B show the assembly device 100 in a locked state in which it is locked with the mating connector 200.

FIG. 1A shows the assembly device 100 that comprises a connector element 102 and a connector position assurance (CPA) device 104, which is inserted into the connector element 102, and more specifically into a connection portion 106 of the connector element 102. In FIGS. 1A to 1D, the CPA device 104 is in a position called a delivery position. The CPA device 104 is mounted to move relative to the connector element 102, between the delivery position, shown in FIGS. 1A to 1D, and a second position called a locking position, shown in FIGS. 2A and 2B.

Figure 4:
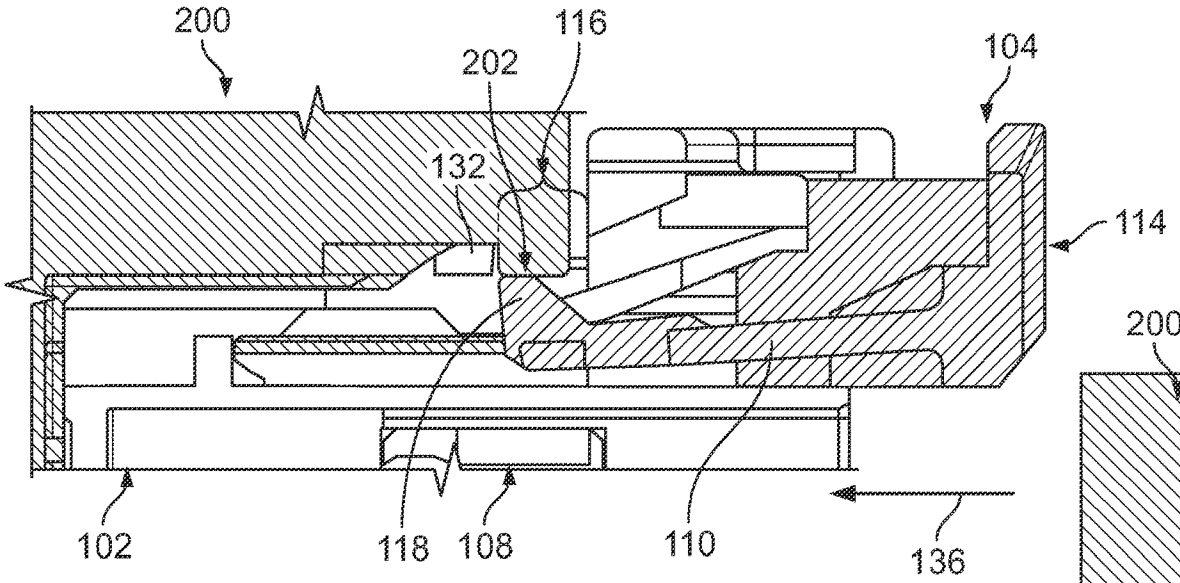
FIG. 4 is a sectional side view of the connector assembly device, taken along section D-D of FIG. 1A, in the presence of the complementary connector and with the CPA device in the delivery position.

A second locking element 108 shown in FIGS. 1B, 2A, and 2B and in FIG. 4 may also be present in the assembly device 100. The second locking element 108 is not involved in the locking mechanism of the CPA device 104 and is therefore not necessary for locking the CPA device 104.

The CPA device 104 has a contact or push surface 114, which is a surface on which a user can exert pressure for inserting the CPA device 104 into the connection portion 106 of the connector element 102, as shown in FIGS. 1A, 1G, 2A, and 2B.

As shown in particular in FIGS. 1A, 1C, and 1D or indeed in FIGS. 1F and 1G, the CPA device 104 comprises a locking lance 110 that extends from a main body 112 of the CPA device 104 in the insertion direction 136, as shown in FIG. 1F. The insertion direction 136 corresponds to the direction going from the delivery position towards the locking position of the CPA device 104. The locking lance 110 extends from a center of the main body 112. The locking lance 110 has a first locking device 118 and a second locking device 120.

In this embodiment, the first locking device 118 is a lance head latch, i.e. a projection perpendicular to the plane surface of the locking lance 110. In FIGS. 1F and 1G, the lance head latch 118 is positioned at the free end 122 of the locking lance 110, opposite from an end 124 connected to the main body 112. Furthermore, the lance head latch 118 is positioned centrally on the locking lance 110 in the direction Y. In a variant, the first locking device 118 may also comprise a plurality of latches. In another variant, the latch may also be positioned in some other position on the locking lance 110.

In this embodiment, the second locking device 120 is a recess in the locking lance 110, in particular a through hole, as shown in FIG. 1F. In this example, the second locking device 120 has two recesses. In a variant, the second locking device 120 may have only one recess. As shown in FIG. 1F, the recesses 120 are adjacent to the lance head latch 118 on either side of the lance head latch 118. Thus, without enlarging the lance 110, it becomes possible to provide a second form-fitting connection. The second locking device 120 is arranged further away from the free end 122 of the locking lance 110 than the lance head latch 118.

The locking lance 110 is a flexible element, in such a manner that, while the CPA device 104 is being inserted into the connector element 102 from the delivery position to the locking position or vice versa, the locking lance 110 can bend downwards, as shown in FIG. 4. Indeed, the locking lance 110 can be deflected in order to enable the CPA device 104 to be inserted from its delivery position towards the locking position in the connector element 102 as plugged into the complementary connector 200, which can be locked with the connector element 102, as shown in FIGS. 2A and 2B. In particular, the locking of the connector element 102 with the complementary connector 200 takes place by form-fitting connection or latching, in particular by snap-fastening, with a locking region 116 of the connector element 102. Furthermore, the locking of the connector element 102 with the complementary connector 200 also takes place by the first locking device 118 of the locking lance 110 of the CPA device 104.

The CPA device 104 further comprises stops 126 that are positioned laterally on the main body 112 of the CPA device 104, on either side of the lance 110, as shown in FIGS. 1F and 1G. The stops 126 may be constituted by latches, and as such projections extending outwards from the lateral sides 128, 130 of the main body 112 of the CPA device 104. The stops 126 are configured in such a manner that when the CPA device 104 is inserted into the connector element 102 to its delivery position, the stops 126 prevents the CPA device 104 from coming back out of the connection portion 106 once it has been inserted to its delivery position. Thus, the CPA device 104 remains assembled with the connector element 102.

The connector element 102 has a first locking device 132 configured to provide the locking with a complementary connector 200 as described above, as shown in FIGS. 1B to 1E. The first locking device 118 of the CPA device 104 is also referred to as an associated locking device because it is associated with the first locking device 132 of the connector element 102 and is configured to implement a form-fitting connection with the first locking device 132 of the connector element 102 in the locking position, so as to lock the connector element 102 when it is plugged into the complementary connector 200, thereby preventing movement of the CPA device 104 in the direction going from the locking position towards the delivery position, as shown in FIG. 2A.

The connector element 102 has a second locking device 134, as shown in FIGS. 1C, 1E, and 2B. The second locking device 134 is associated with the second locking device 120 (also referred to as the associated second locking device) of the locking lance 110 of the CPA device 104, and are configured to implement a second form-fitting connection with the second locking device 120 of the CPA device 104 in the locking position, thereby preventing the CPA device 104 from moving in the direction going from the locking position towards the delivery position, as shown in FIG. 2B.

The first locking device 132 and the second locking device 134 of the connector element 102 are protrusions protruding in different directions, in particular in opposite directions. As shown in FIG. 1E, in the enlarged view of the connection portion 106 of the connector element 102, the protrusions 132, 134 protrude perpendicularly to the direction going from the delivery position towards the locking position, in opposite directions. In particular, in FIG. 1E, the protrusion of the first locking device 132 is a projection extending outwards from a top surface 106*a* of the connection portion 106 of the connector element 102, whereas the protrusions of the second locking device 134 are projections extending outwards from a bottom surface 106*b* of the connection portion 106 of the connector element 102. The first locking device 132 and the second locking device 134 of the connector element 102 have a function of acting as abutments.

The first locking device 118 of the CPA device 104 is arranged and configured such that, in the absence of the complementary connector 200, the CPA device 104 remains blocked, i.e. prevented from moving, in the connector element 102 in its delivery position, which position is the one shown in FIGS. 1A to 1D. Indeed, in the delivery position, the first locking device 118 of the CPA device 104 is in the locking region 116 of the connection portion 106 of the connector element 102, in such a manner that a portion of their protrusion extends outwards from the top surface 106*a* of the connection portion 106 of the connector element 102 and abuts against the first locking device 132, thereby preventing the CPA device 104 from advancing in the insertion direction 136, as is shown in FIGS. 1B, 1C, and 1D.

Furthermore, in its delivery position, the CPA device 104 of the device 100 of the invention is also blocked, i.e. prevented from moving, in the insertion direction 136, because the free end 122 of the locking lance 110 of the CPA device also abuts against the second locking device 134 of the connection portion 106 of the connector element 102, i.e. against the projections or abutments 134, as shown in FIGS. 1C and 1D. In its delivery position, the CPA device 104 cannot be inserted any further into the connector element 102, in particular into the connection portion 106. In this way, the CPA device 104 is blocked, i.e. latched, reliably in its delivery position, while also being blocked, i.e. prevented from moving, in the direction opposite to the insertion direction 136, which is the direction going from the delivery position towards the locking position, by the stops 126 of the CPA device 104.

The form-fitting connection between the first locking device 132 of the connector element 102 and the associated first locking device 118 of the CPA device 104, and the form-fitting connection between the second locking device 134 of the connector element 102 and the associated second locking device 120 of the CPA device 104 preventing insertion of the CPA device 104 towards the locking position take place in different planes. In addition, the planes of the form-fitting connections are parallel to the direction going between the locking position and the delivery position, as shown in FIGS. 1C and 1D.

In the first embodiment shown in FIGS. 1A to 1D, the device 100 is not mated with the complementary connector 200, and the protrusion of the first locking device 118 of the locking lance 110 of the CPA device 104 is thus snap-fastened into the locking region 116 of the connector element 102.

When the complementary connector 200 is plugged into and locked with the connector element 102, the complementary connector 200 is locked at the locking region 116 of the connector element 102, as shown in FIGS. 2A and 2B. The complementary connector 200 has a protrusion 202 that is snap-fastened in a manner known from state of the art with the first locking device 132 of the locking zone 116 of the connector element 102 so as to provide a reliable connection. In the presence of the protrusion 202, the first locking device 132 initially flex downwards and then come back up once the protrusion 202 has gone past, and come to be received in a space 206 in the complementary connector 200.

When the complementary connector 200 is put in place on the connector element 102 so as to be plugged in and locked, its protrusion 202 also comes to bear against the first locking device 118 of the locking lance 110 of the CPA device 104, so that the locking lance 110 is deflected towards the inside of the connection portion 106 in order to enable the CPA device 104 to be inserted from its delivery position towards the locking position in the connector element 102, as shown in FIG. 4. The protrusion 202 of the complementary connector 200 is thus snap-fastened into the locking region 116 of the connection portion 106 that has become free, and the complementary connector 200 is maintained plugged-in and locked with the connector element 102. The CPA device 104 is inserted until it reaches the locking position.

The first locking device 118 of the CPA device 104 leads to the CPA device 104 being unblocked, i.e. unlatched, when the complementary connector 200 is locked to the connector element 102, enabling the CPA device 104 to be inserted to the locking position. In other words, in accordance with the present invention, the CPA device 104 is released from its delivery position only by interaction with the complementary connector 200, and in particular only if the complementary connector 200 has been inserted far enough into the connector element 102.

The CPA device 104 advancing to the position arranged to lock the connector element 102 as plugged into the complementary connector 200 can be achieved only by unlocking, i.e. unlatching, the CPA device 104, which becomes possible only once the connector element 102 is inserted into and locked with the complementary connector 200.

Figure 5:
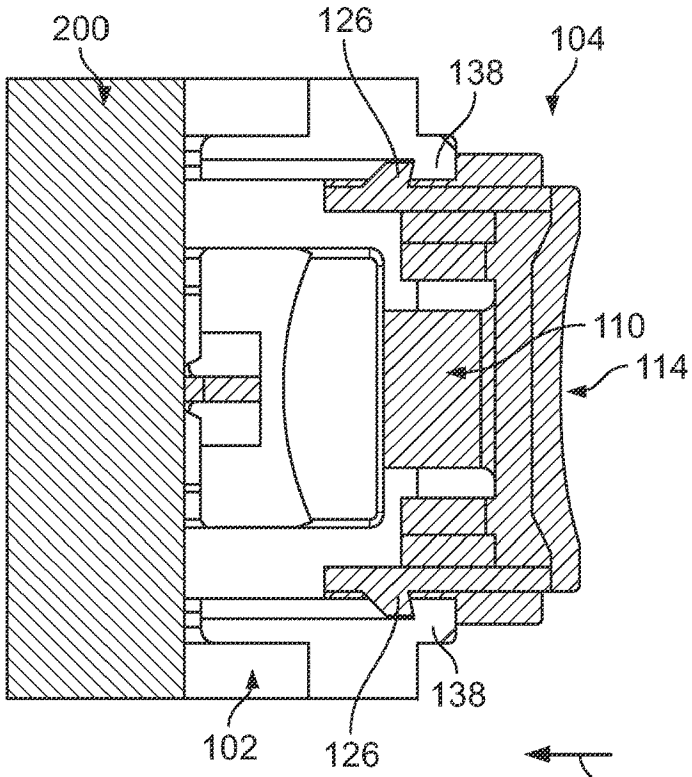
FIG. 5 is a sectional top view of the connector assembly device of FIG. 4.

In FIG. 4, although the CPA device 104 is no longer blocked from moving in the insertion direction 136, because the first locking device 118 of the locking lance 110 no longer abut against the first locking device 132 and become free, i.e. released, the CPA device 104 remains blocked from moving in the direction opposite from the insertion direction 136 by the stops 126 that abut against a latch 138 in the connector element 102, as shown in FIG. 5.

In the locking position of the CPA device 104 and as shown in FIG. 2A, the first locking device 118 of the CPA device have, in the insertion direction 136, gone past the first locking device 132 of the connector element and now implement a form-fitting connection therewith in the direction opposite from the insertion direction 136.

Furthermore, as shown in FIG. 2B, in the locking position of the CPA device 104, the second locking device 120 associated with the second locking device 134 of the connector element 102 also realizes a form-fitting connection with the second locking device 134 of the connector element 102, thereby also preventing any movement of the CPA device 104 in the direction opposite from the insertion direction 136. Indeed, the protrusion of the second locking device 134 engages in a form-fitting manner into the recess 120. By inserting the latch 134 into the recess 120, blocking is implemented in both directions in the plane perpendicular to the section D-D of FIG. 1A, thereby increasing the reliability of the locking, even in the presence of vibration.

Thus, the locking position is achieved by a plurality of form-fitting connections, thereby increasing the resistance to inadvertent unblocking, i.e. to inadvertent unlatching. In particular, by placing the connections in different planes relative to the insertion direction 136, the forces are better distributed and the reliability of the device 100 is increased. The device 100 also complies with the compactness standards required, for example, by motor vehicle manufacturers.

In the locking position of the CPA device 104 in the connector element 102, a retaining force is present at the locking lance 110. Thus, the locking of the CPA device 104 is increased. This also applies for unlocking.

The locking position of the CPA device 104 is achievable with or without continuous stress on the CPA device 104.

Figure 3B:
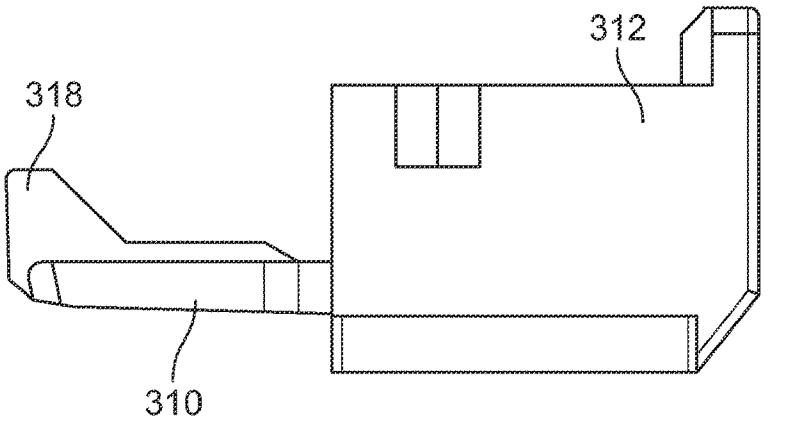
FIG. 3B is a side view of the CPA device of FIG. 3A.
Figure 3A:
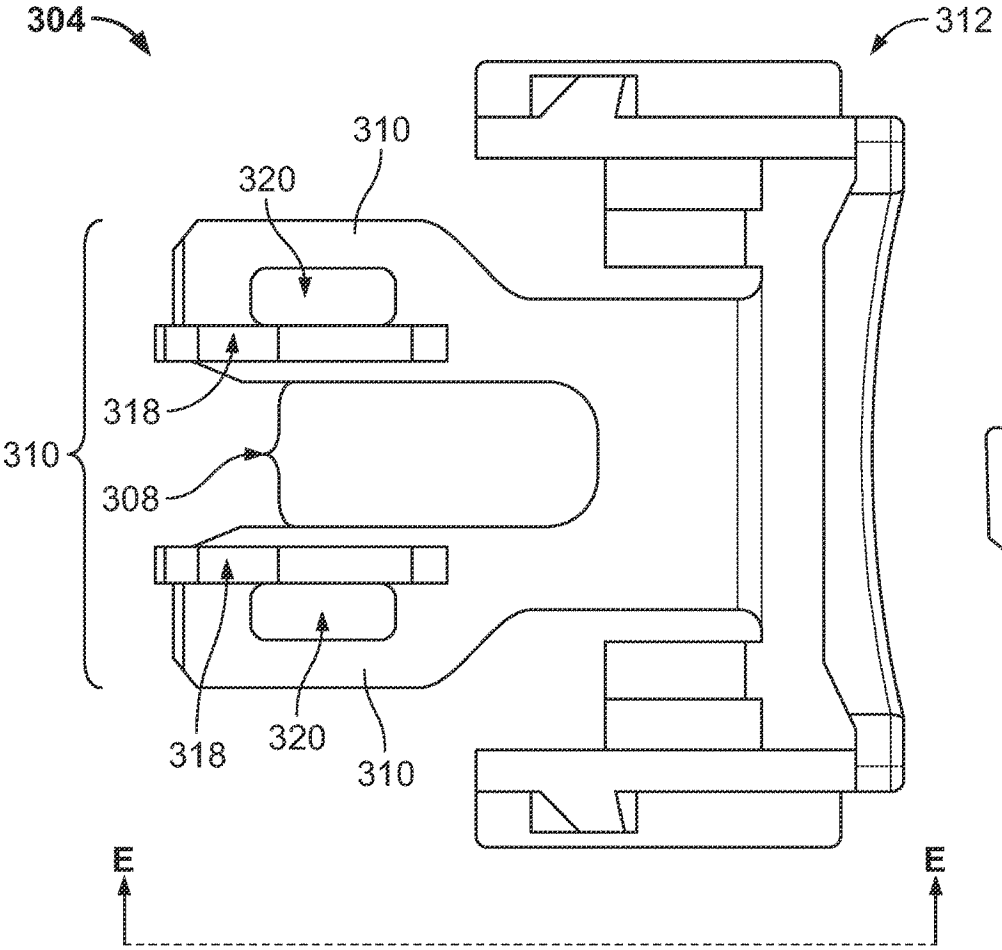
FIG. 3A is a top view of a CPA device according to another embodiment.
Figure 3C:
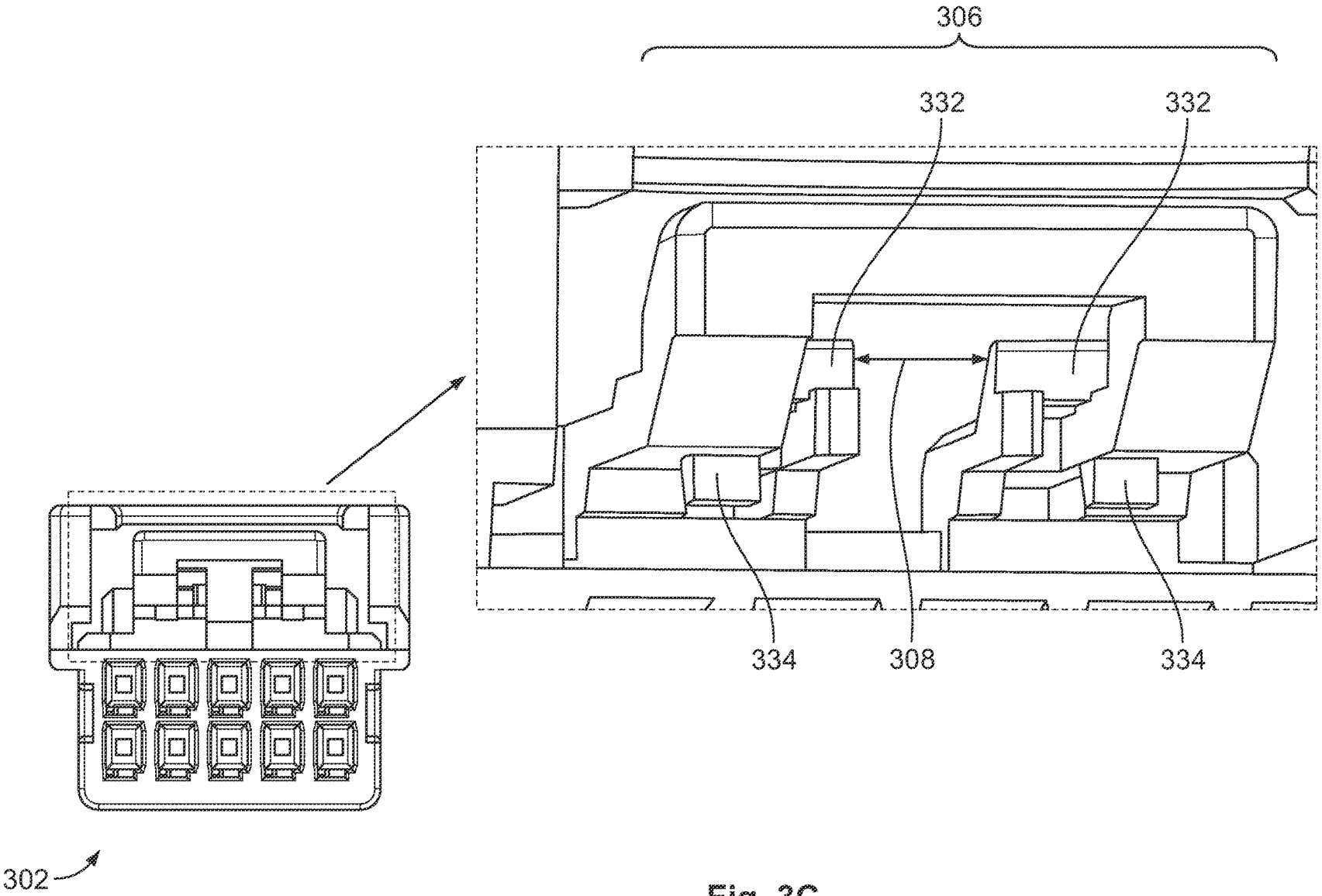
FIG. 3C is a front view of a connector element according to another embodiment.

In a second embodiment of the invention, shown in FIGS. 3A to 3C, the CPA device 304 may include two locking lances 310 that are centered in the central recess of the main body 312 of the CPA device 304 and separated from each other by a central recess 308. In particular, the two locking lances 310 are parallel to each other, each comprising associated first locking device 318, a latch in this example, and associated second locking device 320, a recess in this example. The first locking device 318 and the second locking device 320 of the second embodiment thus correspond essentially to those described for the first embodiment, and they perform the same functionality with a connector element 302 having complementary first and second locking device 332 and 334.

Thus, as shown in FIG. 3C, the connector element 302 includes a connection region 306 having two first locking device 332 associated with the first locking device 318 positioned on respective ones of the locking lances 310 and two second locking device 334 associated with the second locking device 320 positioned on respective ones of the locking lances 310. The two pairs of locking devices 332, 334 are separated by the same distance 308 as the lances 310.

Blocking, i.e. latching, in the delivery position, going from the delivery position to the locking position in the presence of a complementary connector 200, and blocking, i.e. latching, in the locking position take place in the same way as in the first embodiment.

The embodiments described are merely possible configurations, and it should be borne in mind that the individual characteristics of the various embodiments may be combined or be provided independently from one another.

What is claimed is:

1. A connector assembly device, comprising:

a connector element configured to be plugged into and locked with a complementary connector, the connector element including a connection portion, a first locking device and a second locking device, the first locking device and the second locking device protrude from the connection portion in opposite directions; and a connector position assurance (CPA) device mounted to move relative to the connector element between a delivery position and a locking position, the CPA device including a locking lance that is a flexible element and has an associated first locking device configured to implement a first form-fitting connection with the first locking device of the connector element in the locking position so as to lock the connector element when it is plugged into the complementary connector, preventing any movement of the CPA device in a direction from the locking position towards the delivery position, the locking lance has an associated second locking device configured to implement a second form-fitting connection with the second locking device of the connector element in the locking position, preventing any movement of the CPA device in the direction from the locking position towards the delivery position, a form-fitting connection between the first locking device and the associated first locking device and a form-fitting connection between the second locking device and the associated second locking device take place in different planes.

2. The connector assembly device of claim 1, wherein the form-fitting connection between the first locking device and the associated first locking device and the form-fitting connection between the second locking device and the associated second locking device take place in different planes that are parallel to the direction from the locking position towards the delivery position.

3. The connector assembly device of claim 1, wherein in the delivery position and in an absence of the complementary connector, the first locking device and/or the second locking device block the associated first locking device and/or the associated second locking device in a direction from the delivery position towards the locking position.

4. The connector assembly device of claim 1, wherein in the delivery position and in an absence of the complementary connector, a free end of the locking lance abuts against the second locking device.

5. The connector assembly device of claim 1, wherein the first locking device and the second locking device protrude perpendicularly to the direction from the locking position towards the delivery position.

6. The connector assembly device of claim 1, wherein the associated first locking device is a lance head latch.

7. The connector assembly device of claim 6, wherein the associated second locking device has a recess.

8. The connector assembly device of claim 7, wherein the recess is a through hole.

9. The connector assembly device of claim 7, wherein the lance head latch is positioned at a free end of the locking lance.

10. The connector assembly device of claim 9, wherein the recess is adjacent to the lance head latch, on a lateral side of the lance head latch.

11. The connector assembly device of claim 10, wherein the associated second locking device has a second recess positioned on a side of the lance head latch opposite the recess.

12. The connector assembly device of claim 9, wherein the recess is further from the free end than the lance head latch.

13. The connector assembly device of claim 1, wherein the locking lance is one of a pair of locking lances of the CPA device that are parallel to each other.

14. The connector assembly device of claim 13, wherein each of the pair of locking lances has one associated first locking device and one associated second locking device.

15. A connector assembly device, comprising:

a connector element configured to be plugged into and locked with a complementary connector, the connector element including a first locking device and a second locking device; and a connector position assurance (CPA) device mounted to move relative to the connector element between a delivery position and a locking position, the CPA device including a locking lance that is a flexible element and has an associated first locking device configured to implement a first form-fitting connection with the first locking device of the connector element in the locking position so as to lock the connector element when it is plugged into the complementary connector, preventing any movement of the CPA device in a direction from the locking position towards the delivery position, the locking lance has an associated second locking device configured to implement a second form-fitting connection with the second locking device of the connector element in the locking position, preventing any movement of the CPA device in the direction from the locking position towards the delivery position, a form-fitting connection between the first locking device and the associated first locking device and a form-fitting connection between the second locking device and the associated second locking device take place in different planes, and in the delivery position and in an absence of the complementary connector, the first locking device blocks the associated first locking device and the second locking device blocks the associated second locking device in a direction from the delivery position towards the locking position.

* * * * *